US010024629B2

(12) United States Patent
Sheets, Jr.

(10) Patent No.: US 10,024,629 B2
(45) Date of Patent: Jul. 17, 2018

(54) ACCESSORY MOUNTING SYSTEM

(71) Applicant: Sig Sauer, Inc., Newington, NH (US)

(72) Inventor: Robert E. Sheets, Jr., Portland, OR (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/401,402

(22) Filed: Jan. 9, 2017

(65) Prior Publication Data

US 2017/0205196 A1 Jul. 20, 2017

Related U.S. Application Data

(60) Provisional application No. 62/280,015, filed on Jan. 18, 2016.

(51) Int. Cl.
*F41G 1/35* (2006.01)
*F41G 1/44* (2006.01)

(52) U.S. Cl.
CPC ..... *F41G 1/44* (2013.01); *F41G 1/35* (2013.01)

(58) Field of Classification Search
CPC ..... F41G 1/28; F41G 1/35
USPC ..... 42/115
See application file for complete search history.

(56) References Cited

U.S. PATENT DOCUMENTS 3,834,035 A * 9/1974 Merrill ..... F41G 1/08 42/133
6,490,060 B1 * 12/2002 Tai ..... G02B 5/32 33/333
7,140,143 B1 * 11/2006 Ivey ..... F41G 11/003 42/125
2009/0071053 A1 3/2009 Thomele et al.
2010/0325934 A1 * 12/2010 Liu ..... F41G 1/35 42/135
2013/0145672 A1 * 6/2013 Tuller, Jr. ..... F41G 1/00 42/114
2015/0267989 A1 * 9/2015 Hobson ..... F41A 23/24 89/37.12
2016/0102943 A1 * 4/2016 Teetzel ..... F41G 1/35 42/113

* cited by examiner

*Primary Examiner* — Bret Hayes
(74) *Attorney, Agent, or Firm* — Finch & Maloney PLLC

(57) ABSTRACT

A firearm accessory adjustment system is described. The system provides for independent elevation and windage adjustment for a laser associated with a firearm. Each of the elevation and windage adjustments can be made independently using single adjustments on the side of the firearm. The system can be integral to a sidearm.

13 Claims, 4 Drawing Sheets

ACCESSORY MOUNTING SYSTEM

RELATED APPLICATIONS

This application claims priority under 35 USC § 119(e) to U.S. Provisional Patent Application No. 62/280,015 entitled "Accessory Mounting System," filed on Jan. 18, 2016, which is incorporated by reference herein in its entirety.

FIELD

This disclosure relates to systems for mounting and adjusting firearm accessories and, in particular, to a system for mounting and adjusting a laser on a firearm.

BACKGROUND

Firearms are used with a variety of devices that are designed to help improve the accuracy of the user. These devices include, for example, sights, scopes, lasers and combinations thereof. Lasers are aligned with the projected path of the bullet so that when the user points the laser at the target, the bullet follows essentially the same path to arrive at the target. As the path of trajectory can be affected by variables such as distance and wind, adjustments of the alignment of the laser are sometimes helpful to compensate for these variables and improve accuracy.

SUMMARY

In one aspect, an elevation adjuster for a firearm accessory is provided, the elevation adjuster comprising an elevation wedge having a first vertical surface and a first inclined plane normal to the first vertical surface, the inclined plane having a slope angle, an elevation plunger having a contact surface for engaging an accessory, a second surface for engaging the first vertical surface and a second inclined plane for engaging the first inclined plane, and an adjustment screw in contact with a surface of the elevation wedge wherein advancement of the adjustment screw moves the elevation wedge in a first direction and moves the elevation plunger in a second direction that is normal to the first direction. The elevation adjuster can comprise a biasing element that forces the firearm accessory toward the contact surface of the elevation plunger. In other embodiments, the biasing element contacts the firearm accessory less than 170° around the firearm accessory from where the firearm accessory contacts the contact surface. In another embodiment, the elevation adjuster comprises a single adjustment screw, and the adjustment screw is configured and arranged to move in the same direction as the slope angle. The first and second inclined planes can have the same slope angle. In some embodiments the first inclined plane has a slope angle between 10° and 50°. In some embodiments, the firearm accessory comprises a laser housing. In another example, the elevation plunger is seated in a pocket in the firearm and the pocket prevents lateral movement of the elevation plunger. A firearm can include any of the elevation adjusters described herein. The firearm accessory can be integral to a firearm frame, for instance, a sidearm frame.

In another aspect a windage adjuster for a firearm accessory is provided, the windage adjuster comprising a single windage adjustment screw having an end for contacting a housing of the firearm accessory at a contact point, and a biasing element for forcing the housing into the contact point, the biasing element contacting the accessory housing at a second contact point that is less than 170° opposed to the contact point. Another set of embodiments includes a firearm that comprises both the windage adjuster and the elevation adjuster from any of the examples provided above. In some firearm embodiments, the windage adjustment screw and the elevation adjustment screw are essentially parallel. The head of the windage adjustment screw and a head of the elevation adjustment screw can be positioned on the same side of the firearm.

In another aspect a method of adjusting the elevation of a laser mounted on a firearm is provided, the method comprising rotating a screw to advance the screw in a first direction, moving an elevation wedge laterally with a distal end of the screw, contacting an elevation plunger with the elevation wedge to move the elevation plunger in a direction that is about 90° to the first direction, and moving the laser in a vertical direction in unison with the elevation plunger. The method can include reversing the movement of the laser by rotating the screw in the opposite direction. In some embodiments, the laser moves about a fulcrum between the laser head and the elevation screw.

BRIEF DESCRIPTION OF THE DRAWINGS

In the drawings, different embodiments of the invention are illustrated in which.

OVERVIEW

Figure 1:
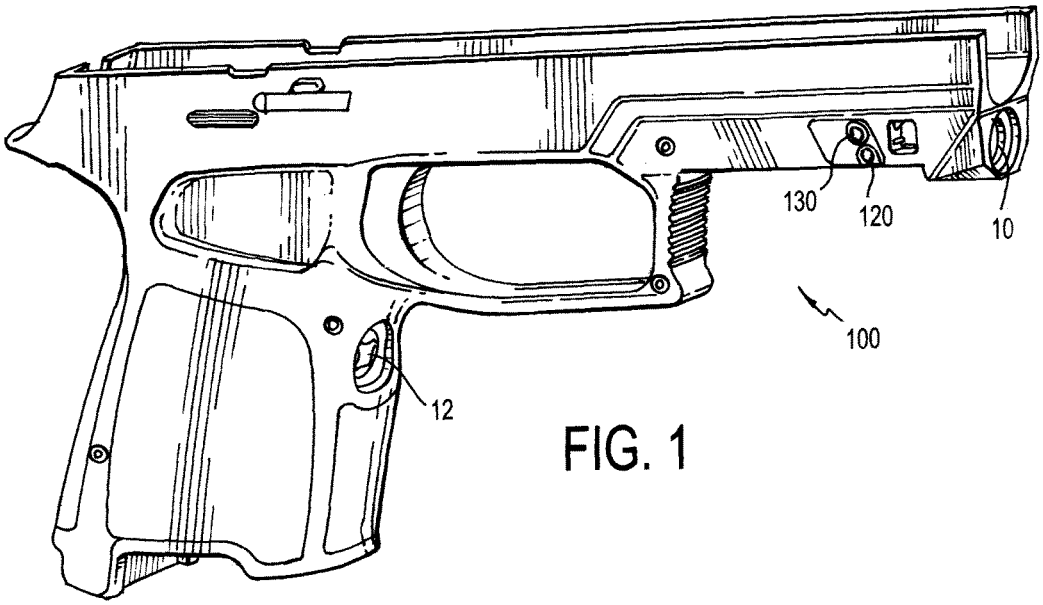
FIG. 1 shows a perspective view of an embodiment of a firearm frame including an accessory compartment.

Described herein are several systems for securing, adjusting and sighting firearm accessories such as laser sights. In one aspect, a firearm laser sight can be mounted on a firearm, a sidearm for example, and can be adjusted for elevation and windage using two external adjustments. The windage and elevation adjustments can be made by adjusting two screws that can be oriented substantially horizontally on the outside of the firearm. The horizontally oriented windage adjustment screw can adjust the horizontal angle of the laser, and the horizontally oriented elevation adjustment screw can be used to adjust the vertical angle of the laser. In some embodiments, the laser may be positioned close to the bore of the firearm, minimizing the error between the bullet path and laser path that can occur at different distances when the laser and bore are not positioned close to each other on the firearm. The laser can be powered by a power source that is on board the firearm such as a battery located in the grip.

Known firearm laser systems can be bulky, difficult to adjust, and less than securely seated. Firearm sighting systems, including lasers, are often adjustable to compensate for the vertical drop of the bullet at different distances caused by gravity (elevation) and for lateral movement of the bullet caused by wind (windage). Windage and elevation adjustment is typically made by adjusting four opposed set screws that hold the laser module in place. By tightening one screw and loosening an opposing screw, the path of the laser in relation to the path of the bullet can be altered. However, this method, and other similar methods, leads to imprecise targeting. For example, adjustments in one axis may shift the device in other axes as well.

In one aspect, the accessory mounting system described herein provides a secure, integral, easily adjustable mount for a laser or other firearm accessory. To improve user accessibility, each adjustment, windage and elevation, can be made by turning a screw that is integral to the side of the firearm. A single adjustment screw can be used to move the laser left or right and a second adjustment screw can be used to move the laser up and down, with respect to the firearm. In many embodiments, horizontal movement is independent and isolated from vertical movement and vertical movement is independent and isolated from horizontal movement. As a result, a user can adjust elevation without being concerned about concurrent windage variation and, similarly, can adjust horizontally without being concerned about concurrent vertical movement. One end of the laser, the end distal from the optics for example, can be retained by the combination of a platform that supports the laser housing vertically, a windage adjustment feature that supports the laser housing horizontally, and one or more biasing elements, such as springs, that apply forces to keep the laser housing pressed against the platform and the windage adjustment feature. The one or more biasing elements allow the laser housing to be moved one direction when the adjustment feature is advanced and in the opposite direction when the adjustment feature is retracted. In some embodiments, parts such as wedges, plungers, screws, pockets, housings and springs may be formed from metals such as hardened steel or from polymers such as polyamide or thermopolymers.

In many embodiments, the laser housing can be supported by a platform that can be moved up and down by adjusting the elevation adjustment mechanism. The platform can be, for example, on top of the laser housing or underneath the laser housing. In either case, the housing can be held against the platform by one or more biasing elements that pushes against the laser housing at a point greater than 90 degrees around the laser housing from the point of contact with the platform. Horizontal advancement or retraction of the elevation adjustment mechanism is translated into purely vertical movement to advance or retract the laser housing in a vertical axis. This can be done, for example, using a two module adjustment mechanism in which a first module includes an inclined plane that engages and rides along a complementary inverted inclined plane on a second module. The first module can be controlled by the elevation adjustment mechanism and slides back and forth horizontally when the elevation adjustment mechanism is advanced or retracted. As the first module is advanced by the elevation adjustment mechanism, the inclined plane of the first module moves horizontally as well. The second module is retained by a horizontally oriented pocket with a radial wall so that the second module is prevented from moving horizontally and can only move up or down. As the first inclined plane moves horizontally against the second, the second module is raised or lowered accordingly. The angle of the complementary planes is one factor in the rate of elevation gain or loss for a given advancement or retraction of the elevation adjustment mechanism. The lower the angle, the less vertical movement for each unit of lateral movement of the first module.

DETAILED DESCRIPTION

Looking to the figures, one embodiment of a firearm frame 100 is provided in FIG. 1. The frame includes internally molded electrical circuits for providing power and control to accessories such as laser module 10. As shown, laser module 10 is integral to the firearm frame, and the axis of the laser is close to the axis of the bore of the barrel. In some embodiments, the laser may be positioned so that the axis of the laser beam is less than 4 cm, less than 3 cm, less than 2 cm or less than 1 cm from the axis of the bore of the barrel. Laser module 10 can be activated by switch 12 and the elevation of the laser can be altered using adjustment 120 while the windage can be changed using adjustment 130. As shown, each of adjustments 120 and 130 are horizontally oriented screws that can be advanced or retracted using a tool such as a Philips screwdriver, Allen key or star driver. The screws may be either right handed threaded or left handed threaded to move the laser in a way that is most intuitive to the user. For instance, the screws may be threaded so that turning adjustment 120 clockwise lowers the angle of the laser, raising the bore angle in relation to the target. Similarly, adjustment 130 can be threaded so that clockwise rotation of the screw shifts the angle of the laser left, moving the bore angle of the firearm to the right in relation to the target. This will compensate, for example, for a right to left wind.

Figure 2:
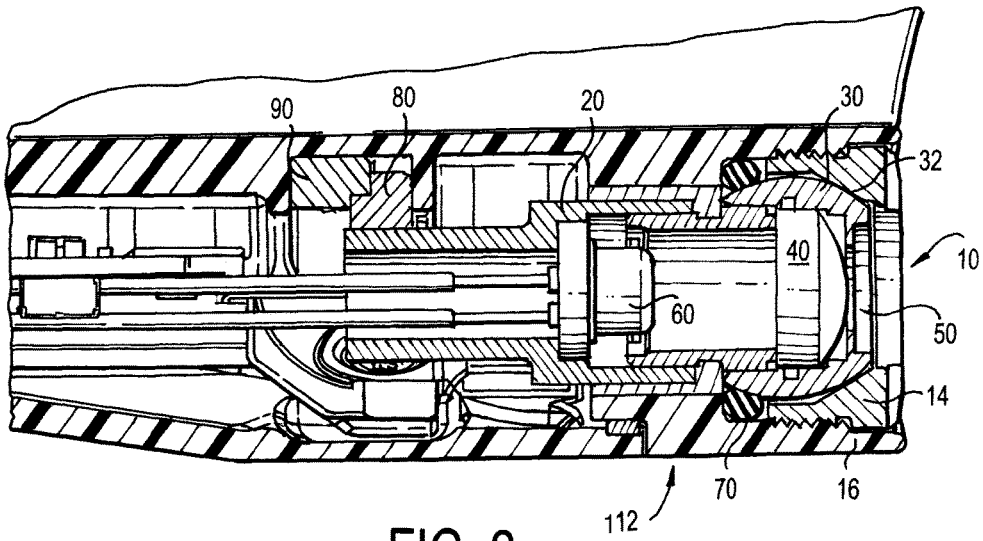
FIG. 2 shows a cutaway side view of one embodiment of an accessory mounting system.

FIG. 2 provides a cutaway view of laser module 10 that is secured to a firearm by mounting system 112. Laser module 10 includes optics 40, window 50, housing 20 and laser diode 60. Conical retaining ring 14 includes external threads that mate with the internal threads of mounting system housing 16. As retaining ring 14 is screwed into housing 16, it presses against spherical head 30 of laser module 10 and squeezes against resilient o-ring 70. Retaining ring 14 is torqued to a level where o-ring 70 is partially compressed but where movement at interface 32 between retaining ring 14 and spherical head 30 can still occur when the laser housing 20 is adjusted. O-ring 70 can act as an annular fulcrum in which the laser can pivot. Therefore when the end of laser module 10 that is proximal to o-ring 70 (including optics 40 and window 50) moves one direction, the end distal to o-ring 70 (including laser diode 60) moves in the opposite direction. Elevation wedge 90 and elevation plunger 80 work together to adjust the elevation of laser module 10 (top to bottom as provided in FIG. 2).

Figure 3:
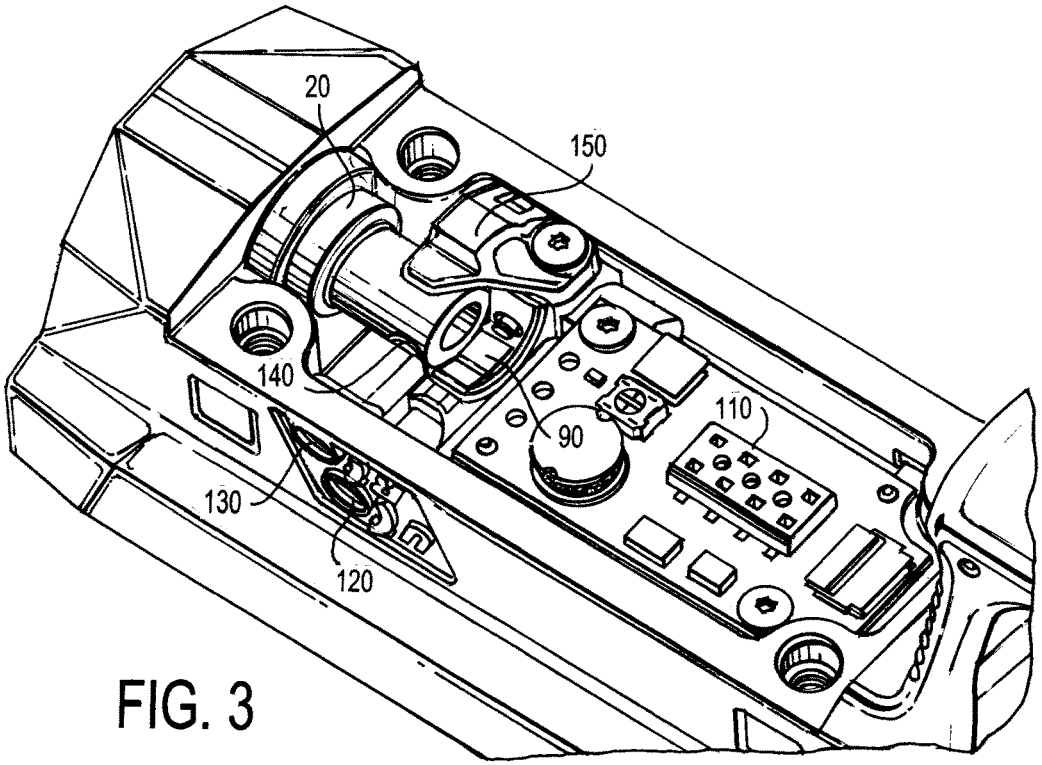
FIG. 3 shows a perspective view of the embodiment of FIG. 2.

FIG. 3 provides a perspective view (from the bottom) of laser housing 20 retained in mounting system housing 16. The compartment shows electrical connector 110 that can supply power and electronic control to the laser. Windage adjustment feature 140 can be advanced and retracted horizontally by rotating windage adjustment screw 130. Clamp 150 retains laser module 10 in the compartment and can include a universal biasing spring 210 (see FIG. 4) that applies a force that presses laser module 10 against elevation plunger 80 (hidden) and against windage adjustment feature 140. In this manner, a single counterforce provided by the biasing spring can secure the laser module and prevent unwanted movement in both the horizontal and vertical directions.

Figure 4:
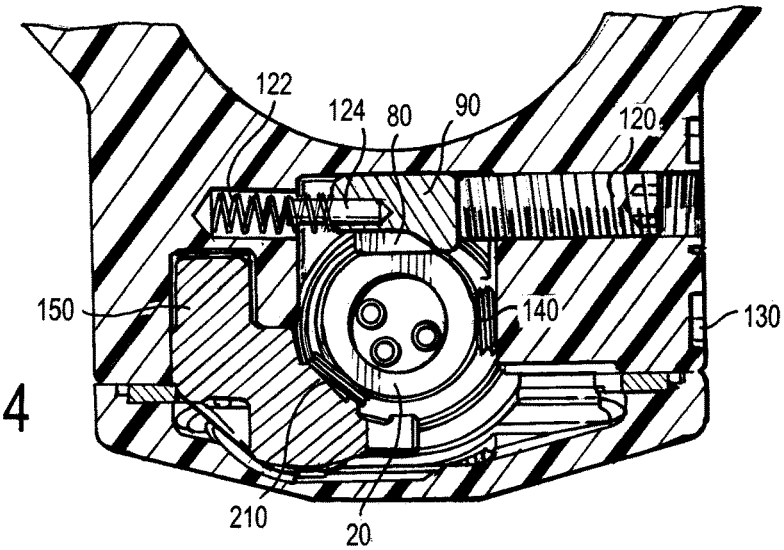
FIG. 4 provides an axial cutaway view of the embodiment of FIG. 2.
Figure 5:
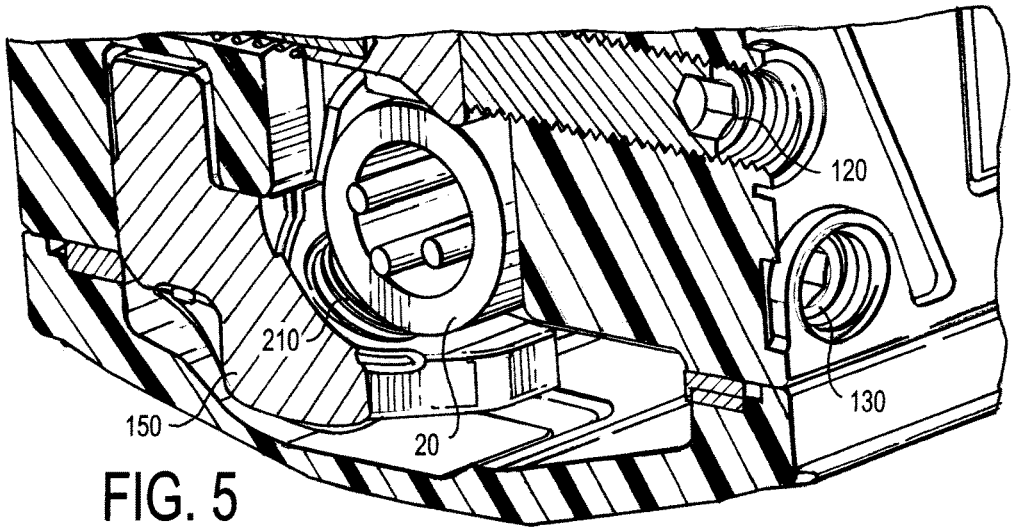
FIG. 5 shows the view of FIG. 4 from a different angle.

FIGS. 4 and 5 provide, respectively, a cutaway axial view and a cutaway perspective view of an embodiment showing the laser module and compartment and illustrate the features that provide for vertical and horizontal control of the laser. Universal biasing spring 210 pushes laser housing 20 into windage adjustment feature 140 as well as into elevation plunger 80. Elevation adjustment screw 120 can be rotated to advance or retract elevation wedge 90. Elevation adjustment biasing spring 122, retained in position by pin 124, is in compression and provides a force that keeps elevation wedge 90 in contact with the distal end (left end as shown) of elevation adjustment screw 120, whether the elevation wedge 90 is moving to the left or the right. When elevation wedge 90 moves left (as viewed in FIG. 4) biasing spring 122 is further compressed. When elevation wedge 90 moves right, biasing spring 122 is extended. The force supplied by biasing spring 122 should be strong enough to maintain the contact of elevation wedge 90 and elevation adjustment screw 120 while not too strong to prevent advancement of the elevation wedge when elevation adjustment screw 120 is manually turned. In other embodiments, the elevation adjustment biasing spring 122 can be eliminated by rotationally coupling elevation adjustment screw 120 to elevation wedge 90 so that the two move in unison in both directions. For example, a vertically oriented T-shaped channel on the side of elevation wedge 90 can be slid over a button that is formed on the end of screw 120. When rotated, the button will rotate freely within the slot but will push elevation wedge 90 when the screw is advanced and will pull elevation wedge 90 when the screw is retracted. In this embodiment it may be preferred that the elevation screw is made of a polymer such as polyamide.

Figure 6A:
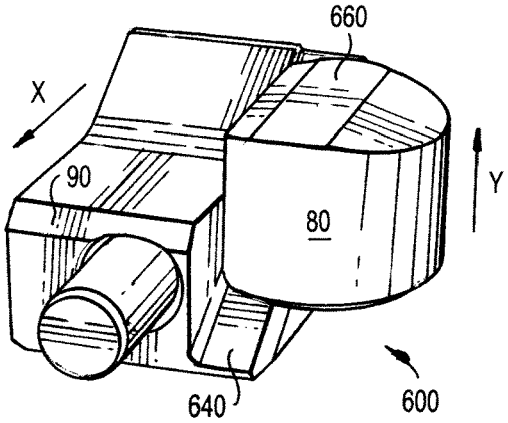
FIG. 6A is a perspective view of an embodiment of an elevation adjustment module.
Figure 6B:
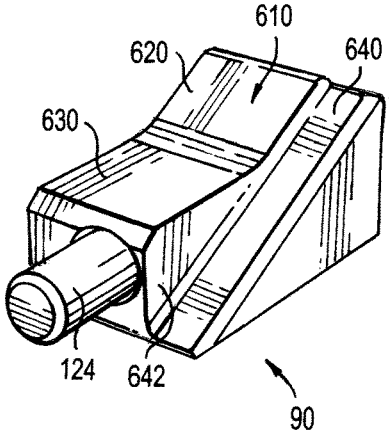
FIG. 6B is a perspective view of one of the components of the module of FIG. 6A.
Figure 6C:
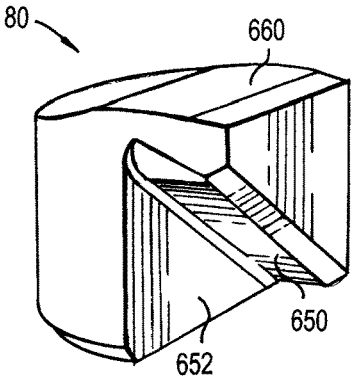
FIG. 6C is a perspective view of a second component of the module of FIG. 6A.

FIGS. 6A, 6B, and 6C provide various views of some or all of the components of one embodiment of an elevation module 600. Concurrent reference to these three figures and the following corresponding description is made to facilitate explanation.

Elevation module 600 comprises at least two distinct parts including elevation wedge 90 and elevation plunger 80. Elevation wedge 90 includes upper surface 610 that may be non-planar and can be generally concave. Surfaces 620 and 630 may be oriented on intersecting planes to provide concavity to surface 610. Surface 610 of elevation wedge 90 can be shaped so that it does not contact or support laser housing 20 which can be supported and engaged exclusively by surface 660 of elevation plunger 80. Elevation wedge 90 and elevation plunger 80 can be made from similar materials and may be metallic, such as hardened steel, or, for example, can be polymeric. The materials should have a low coefficient of thermal expansion so that the elevation of the laser is not altered by changes in temperature. These materials, at least inclined planes 640 and 650, can exhibit low friction coefficients so that they can slide against each other smoothly with minimum force. In some embodiments, these surfaces may be polished steel, may be lubricated, or can be coated with a low friction material such as a fluorinated polymer, e.g., PTFE. The angle of the inclined planes is measured from horizontal and can be, in various embodiments, less than 90°, less than 70°, less than 50°, less than 40° or less than 30°. In specific embodiments the angle of the inclined plane can be in the range of from 10° to 50°, from 20° to 50° or from 20° to 40°. In many embodiments, the angle of the two complementary inclined planes can be the same. Side walls 642 and 652 may also be in slidable contact with each other and therefore may also comprise a low friction material such as polished steel, lubricated steel or a polymer such as PTFE.

Figure 7:
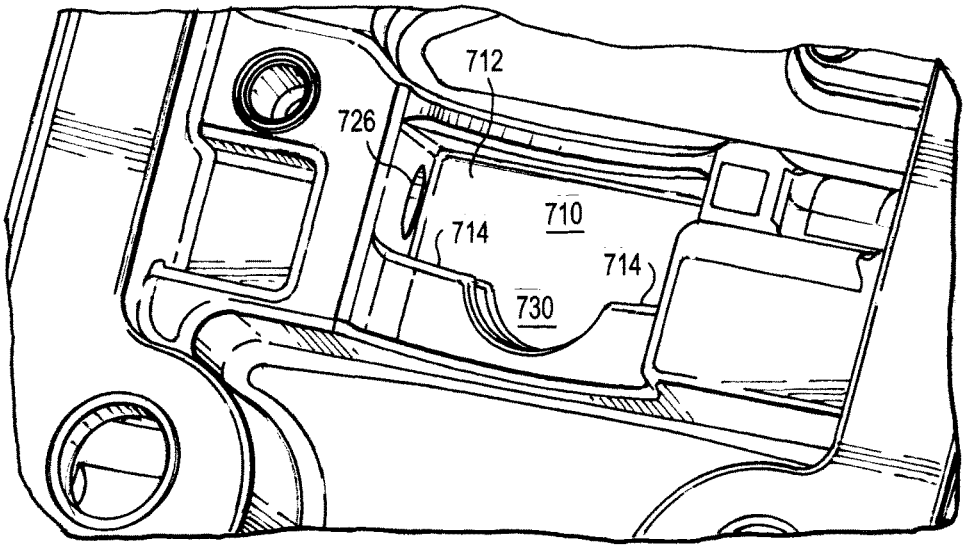
FIG. 7 is a view of a portion of a firearm frame for receiving the module of FIG. 6A.
Figure 8:
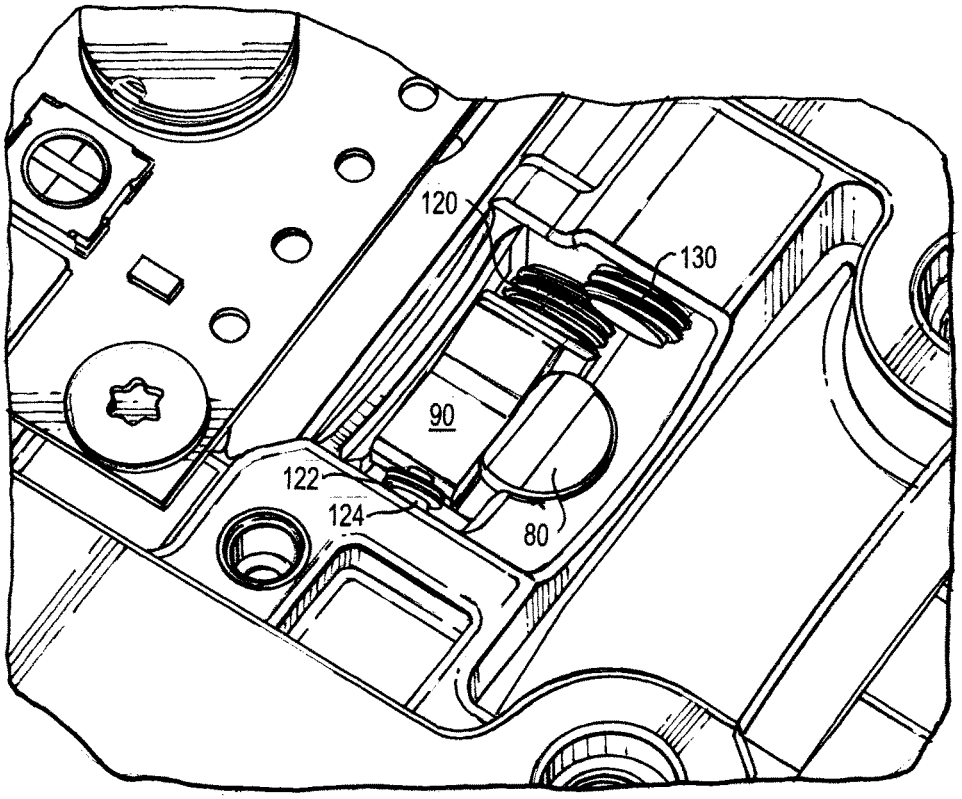
FIG. 8 shows a perspective view of the module of FIG. 6A seated in the frame of FIG. 7.

Elevation module 600 can be placed into wedge pocket 710 and plunger pocket 730 (FIG. 7). FIG. 8 provides a perspective view of elevation module 600 after it has been seated in the pockets. Although FIG. 8 does not illustrate the respective elevations of the two parts, surface 660 of plunger 80 is extended beyond surface 610 of wedge 90 as can be noted from FIGS. 2 and 6A. As a result, laser housing 20 (not shown) is engaged by surface 660 of plunger 80. When assembling the module, wedge 90 can be placed in pocket 710 first and is then followed by placement of plunger 80 into pocket 730. Wedge 90 and plunger 80, as shown, are not connected to each other. Plunger pocket 730 prevents plunger 80 from moving laterally and plunger 80 is retained in plunger pocket 730 by elevation wedge 90, which fits snugly but slidably between walls 712 and 714. Elevation wedge 90 is free to move laterally and is retained in position by elevation adjustment screw 120 and elevation adjustment biasing spring 122. As elevation adjustment screw advances elevation wedge 90 laterally in the x direction (FIG. 6A), elevation plunger 80 is prevented from moving laterally by the radial wall of plunger pocket 730. As a result, inclined plane 640 passes along inclined plane 650 and forces plunger 80 vertically in the y direction, as shown in FIG. 6A. When elevation adjustment screw 120 is reversed, elevation adjustment screw biasing spring 122 pushes elevation wedge 90 in the opposite direction. As laser housing 20 is pressed against surface 660 by the constant force of universal biasing spring 210 (FIGS. 4 and 5), plunger 80 is moved in the negative y direction (as shown) as elevation wedge 90 is retracted in the negative x direction. Note that while y is in a vertical axis with respect to the firearm, in many embodiments y is downward, not upward, when the firearm is held in the firing position.

As shown in FIG. 4, windage adjustment screw 130 includes contact end 140 that interfaces with the surface of laser housing 20. In some embodiments, windage adjustment screw 130 can be complemented by an opposed biasing spring (not shown) that provides a biasing force 180° from the point of contact of the screw. This design may be similar to the elevation adjustment screw biasing spring 122. In the embodiment shown in FIGS. 4 and 8 however, the biasing force is provided by biasing spring 210 which can be positioned, supported and adjusted using clamp 150. Although the vector of the biasing force provided by biasing spring 210 may be less than 180° (e.g., 120°) from the axis of the windage adjustment screw 130, the support provided to the laser housing by elevation module 600 means that the off center biasing force can keep laser housing 20 in contact with both windage contact end 140 and with elevation plunger contact surface 660. When the windage adjustment screw 120 is advanced, biasing spring 210 is compressed, although by less than the adjustment screw is advanced. In reverse, when the windage adjustment screw is retracted, biasing spring 210 expands to keep laser housing 20 in direct contact with windage contact end 140.

Elevation adjustment screw 120 and windage adjustment screw 130 can include any type of head that enables the user to adjust the mechanism. In many embodiments, the head is no wider than the threaded portion of the screw, enabling the head end of the screw to move freely inwardly and outwardly as the screw is rotated. Note that the screw is not used to join pieces together but is used to convert rotational movement into axial travel. In some cases, the screw is configured to be adjustable using fingers only, but in most cases a tool is used. The tool can be a standard tool such as a Philips or slotted screwdriver, an Allen wrench, a star driver or similar. In other cases, the head design may be proprietary and require a specific tool. The elevation adjustment screw 120 and windage adjustment screw 130 may comprise the same type and size of head so that the same tool can be used. In other embodiments the screw heads are different so that the user does not adjust the wrong screw. The respective tools can be labeled or color coded, for example, to match them to the proper adjustment screw, either elevation or windage.

Several factors may determine how far the windage and elevation adjustment are advanced for one rotation of the respective adjustment screw. For windage and elevation adjustment, at least two factors can affect the rate of adjustment. The first is the thread pitch of the adjustment screw. The second is the distance between the point of contact where the adjuster contacts the laser housing and the fulcrum, e.g., o-ring 70. For the elevation adjustment, the angle of inclined planes 640 and 650 will also affect the rate of adjustment.

Each of the adjustment screws may have the same or different thread pitches. For example, given a fixed inclined plane angle and a fixed distance from the adjuster to the o-ring 70, the thread pitch can be selected so that one revolution advances the windage or elevation adjustment of the laser housing by a specific angle, for example, 1 minute, 2 minutes, 5 minutes, 10 minutes, 30 minutes or 1 degree. In other embodiments, a single revolution of the adjustment screw can, for example, adjust for a 25, 50 or 100 yard elevation adjustment or, a 5 mph wind at 25, 50 or 100 yards. The screw head and/or border on the frame housing around the screw head may include indicia that provide information regarding the amount of elevation or windage adjustment that equates to a specific portion of a turn or a specific number of turns. Directional arrows may be used to indicate, for example, up, down, left or right.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. An elevation adjuster for a firearm accessory comprising:

an elevation wedge having a first vertical surface and a first inclined plane normal to the first vertical surface, the inclined plane having a slope angle;

an elevation plunger having a contact surface for engaging an accessory, a second surface for engaging the first vertical surface and a second inclined plane for engaging the first inclined plane; and an adjustment screw in contact with a surface of the elevation wedge wherein advancement of the adjustment screw moves the elevation wedge in a first direction and moves the elevation plunger in a second direction that is normal to the first direction.

2. The elevation adjuster of claim 1 comprising a biasing element that forces the firearm accessory toward the contact surface of the elevation plunger.

3. The elevation adjuster of claim 2 wherein the biasing element contacts the firearm accessory less than 170° around the firearm accessory from where the firearm accessory contacts the contact surface.

4. The elevation adjuster of claim 1, wherein the adjustment screw is configured and arranged to move in the same direction as the slope angle.

5. The elevation adjuster of claim 1, wherein the first and second inclined planes have the same slope angle.

6. The elevation adjuster of claim 1, wherein the first inclined plane has a slope angle between 10° and 50°.

7. The elevation adjuster of claim 1, wherein the firearm accessory comprises a laser housing.

8. The elevation adjuster of claim 1, wherein the elevation plunger is seated in a pocket in a firearm and wherein the pocket prevents lateral movement of the elevation plunger.

9. A firearm comprising the elevation adjuster of claim 1.

10. A sidearm comprising the elevation adjuster of claim 1, wherein the firearm accessory is integral to a sidearm frame.

11. A method of adjusting an elevation of a laser mounted on a firearm, the method comprising:

rotating a screw to advance the screw in a first direction;

moving an elevation wedge laterally with a distal end of the screw;

contacting an elevation plunger with the elevation wedge to move the elevation plunger in a direction that is about 90° to the first direction; and moving the laser in a vertical direction in unison with the elevation plunger.

12. The method of claim 11 further comprising reversing movement of the laser by rotating the screw in the opposite direction.

13. The method of claim 11, wherein the laser moves about a fulcrum between a laser head and an elevation screw.

* * * * *